US006597087B2

(12) United States Patent
Roberts et al.

(10) Patent No.: US 6,597,087 B2
(45) Date of Patent: Jul. 22, 2003

(54) MINIATURE XENON ARC LAMP WITH CATHODE SLOT-MOUNTED TO STRUT

(75) Inventors: Roy D. Roberts, Hayward, CA (US); William L. Manning, Walpole, MA (US)

(73) Assignee: PerkinElmer Optoelectronics, N.C., Inc., Fremont, CA (US)

( * ) Notice: Subject to any disclaimer, the term of this patent is extended or adjusted under 35 U.S.C. 154(b) by 210 days.

(21) Appl. No.: 09/789,878

(22) Filed: Feb. 20, 2001

(65) Prior Publication Data

US 2002/0167255 A1 Nov. 14, 2002

(51) Int. Cl.[7] ..... H01J 5/16; H01J 61/28; H01J 61/40; H01J 61/00; H01J 11/00; H01J 17/00; A47B 81/00; A47B 97/00; A47G 19/26

(52) U.S. Cl. ..... 313/113; 313/567; 313/634; 313/631; 313/632; 313/281; 313/284; 313/285; 445/29

(58) Field of Search ..... 313/643, 113, 313/632, 631, 608, 623, 637, 281, 284, 285, 288, 634, 252, 269, 292; 445/29

(56) References Cited

U.S. PATENT DOCUMENTS 6,281,629 B1 * 8/2001 Tanaka et al. ..... 313/631
6,285,131 B1 * 9/2001 Kiss et al. ..... 313/634

* cited by examiner

*Primary Examiner*—Sandra O'Shea
*Assistant Examiner*—Peter Macchiarolo
(74) *Attorney, Agent, or Firm*—Thomas E. Schatzel; Law Offices of Thomas E. Schatzel, A Prof. Corp.

(57) ABSTRACT

An arc lamp comprises a single edge-to-edge cathode support strut on which the cathode is mounted with an end slot. Such makes heat and thermal stress loading on the assembly symmetrical over operational time, and arc tip wander from the anode center is practically eliminated. Nine component parts that are brought together in only three brazes and one TIG-weld to result in a finished product. An anode assembly is brazed with the rest of a body sub-assembly in one step instead of two. A single-bar cathode-support strut is brazed together as one step. A window flange and a sapphire output window are brazed together with the product of the strut braze step in a mounted-cathode-braze step. A copper-tube fill tubulation, a kovar sleeve, a ceramic reflector body, an anode flange, and a tungsten anode are all brazed together in a "body-braze" step. The products of the mounted-cathode-braze step and body-braze step are tungsten-inert-gas (TIG) welded together in a final welding step. A lamp is finished by filling it with xenon gas and pinching off the tubulation.

11 Claims, 5 Drawing Sheets

MINIATURE XENON ARC LAMP WITH CATHODE SLOT-MOUNTED TO STRUT

BACKGROUND OF THE INVENTION

1. Field of the Invention

The invention relates generally to arc lamps, and specifically to components and methods used to reduce the cost of manufacturing xenon arc lamps.

2. Description of the Prior Art

Short arc lamps provide intense point sources of light that allow light collection in reflectors for applications in medical endoscopes, instrumentation and video projection. Also, short arc lamps are used in industrial endoscopes, for example in the inspection of jet engine interiors. More recent applications have been in color television receiver projection systems and dental curing markets.

A typical short arc lamp comprises an anode and a sharp-tipped cathode positioned along the longitudinal axis of a cylindrical, sealed concave chamber that contains xenon gas pressurized to several atmospheres. U.S. Pat. No. 5,721,465, issued Feb. 24, 1998, to Roy D. Roberts, describes such a typical short-arc lamp. A typical xenon arc lamp, such as the CERMAX marketed by ILC Technology (Sunnyvale, Calif.) has a three-legged strut system that holds the cathode electrode concentric to the lamp's axis and in opposition to the anode.

The manufacture of high power xenon arc lamps involves the use of expensive and exotic materials, and sophisticated fabrication, welding, and brazing procedures. Because of the large numbers of xenon arc lamps being produced and marketed, every opportunity to save money on the materials and/or assembly procedures is constantly being sought. Being the low-cost producer in a market always translates into a strategic competitive advantage.

For example, the CERMAX-type arc lamp 100 shown in FIG. 1 is a common type sold in the commercial market. The manufacturing of lamp 100 can easily cost the biggest part of one hundred dollars for material and labor. The total manufacturing costs set the minimum amount that can be charged at retail, so the production volumes that can be sold are limited by the high price points that must be charged. The lamp 100 is conventional and comprises an optical coating 102 on a sapphire window 104, a window shell flange 106, a body sleeve 108, a pair of flanges 110 and 112, a three-piece strut assembly 114, a two percent thoriated tungsten cathode 116, an alumina-ceramic elliptical reflector 118, a metal shell 120, a copper anode base 122, a base support ring 124, a tungsten anode 126, a gas tubulation 128, and a charge of xenon gas 130. All of which are brazed together in several discrete brazing operations.

It has been discovered by the present inventors, Roberts and Manning, that cathode electrodes that are attached to one side or the other of a supporting strut will experience a deflection of the distal arc-end to one side of the anode during operation. What is needed is a construction and method that provide for a stabilized cathode electrode position during operation.

SUMMARY OF THE PRESENT INVENTION

It is therefore an object of the present invention to provide a xenon ceramic lamp that is less expensive to produce than conventional designs.

It is another object of the present invention to provide a low-cost xenon ceramic lamp that works equally as well as more expensive conventional designs.

Briefly, an arc lamp comprises a single edge-to-edge cathode support strut on which the cathode is mounted with an end slot. Such makes heat loading on the assembly symmetrical over operational time, and arc tip wander from the anode center is practically eliminated. Nine component parts that are brought together in only three brazes and one TIG-weld to result in a finished product. An anode assembly is brazed with the rest of a body sub-assembly in one step instead of two. A single-bar cathode-support strut is brazed together as one step. A window flange and a sapphire output window are brazed together with the product of the strut braze step in a mounted-cathode-braze step. A copper-tube fill tubulation, a kovar sleeve, a ceramic reflector body, an anode flange, and a tungsten anode are all brazed together in a "body-braze" step. The products of the mounted-cathode-braze step and body-braze step are tungsten-inert-gas (TIG) welded together in a final welding step. A lamp is finished by filling it with xenon gas and pinching off the tubulation.

An advantage of the present invention is that a ceramic arc lamp is provided that is less expensive to manufacture compared to prior art designs and methods.

Another advantage of the present invention is that a ceramic arc lamp is provided that is simple in design.

A further advantage of the present invention is that a ceramic arc lamp is provided that has a single-bar cathode-support strut.

A still further advantage of the present invention is that a ceramic arc lamp is provided that requires fewer sub-assemblies.

These and other objects and advantages of the present invention will no doubt become obvious to those of ordinary skill in the art after having read the following detailed description of the preferred embodiments which are illustrated in the drawing figures.

IN THE DRAWINGS

DETAILED DESCRIPTION OF THE PREFERRED EMBODIMENT

Figure 2:
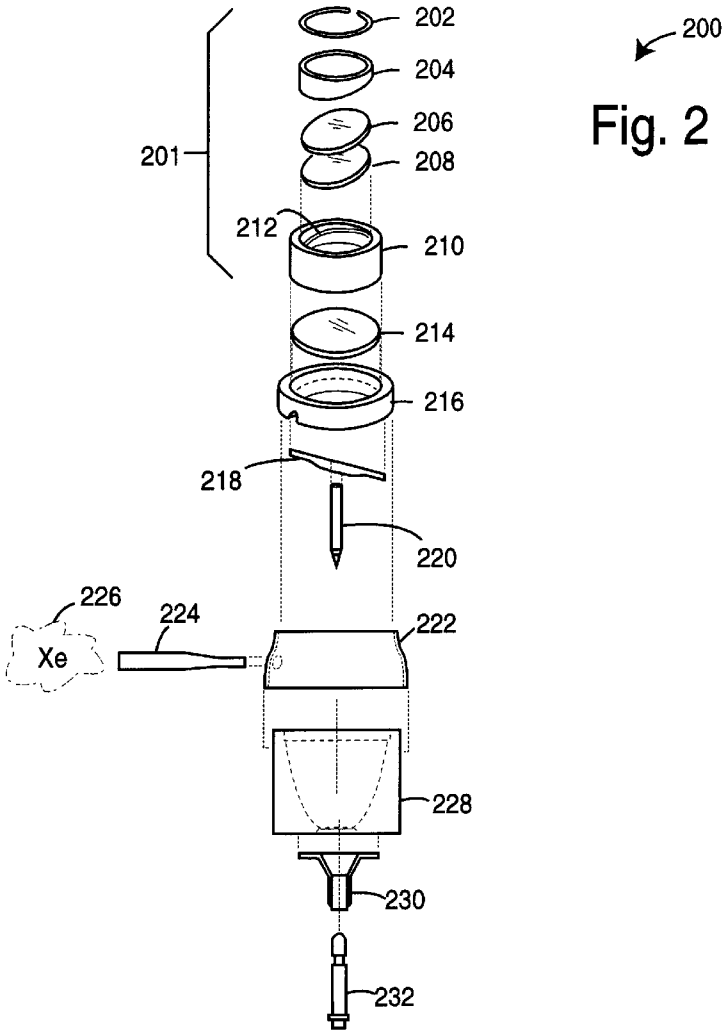
FIG. 2 is an exploded assembly diagram of a CERMAX-type arc lamp embodiment of the present invention.

FIG. 2 illustrates a xenon short-arc lamp embodiment of the present invention, and is referred to herein by the general reference numeral 200. The lamp 200 is shown with a tilted hot mirror assembly 201 that comprises a retaining ring 202, a 10° tilted collar 204, a blue filter 206, a hot-mirror 208, and a ring housing 210. A 10° tilted land 212 inside the ring housing 210 matches the orientation of the 100 tilted collar 204. Such tilted hot mirror assembly 201 is not always used in conjunction with the remainder of lamp 200.

Figure 1:
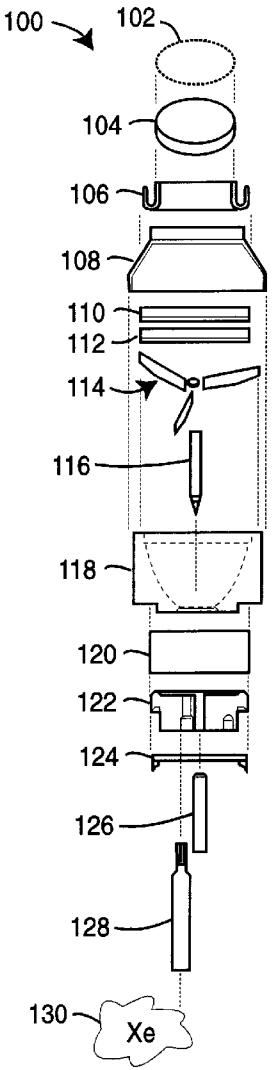
Fig. 1 (prior art)
FIG. 1 is an exploded assembly diagram of a prior art CERMAX-type arc lamp.

The lamp 200 includes a sapphire window 214 set in a ring frame 216. When any filter coatings are included with sapphire window 214, such coatings are faced inward. A single bar strut 218 attaches at opposite points on the bottom of the ring frame 216. A cathode 220 has a slotted end opposite to the pointed arc-discharge end. The strut 218 is brazed inside the slot of the cathode 220. A body sleeve 222 has a xenon-fill tubulation 224 made of copper tubing. This contrasts with the prior art represented in FIG. 1 where the xenon gas is introduced through the anode base. A xenon gas charge 226 is injected into the lamp 200 after final assembly and after all brazing has been completed. A ceramic reflector 228 had a 0.75" diameter in one embodiment of the present invention that was used in a piece of dental equipment. An anode flange 230 brazes directly to the flat bottom end of the ceramic reflector 228 and coaxially aligns a tungsten anode 232.

The lamp 200 therefore has fewer parts, uses less expensive materials, requires simpler tooling, and needs fewer assembly steps, compared to conventional CERMAX-type arc lamps.

Tables I and II compare the manufacturing costs for similar CERMAX-type lamps. Table I represents the component costs in 1999 for lamp 100 (FIG. 1), and normalizes the total direct cost of lamp 100 to be one-hundred percent for comparison purposes. Table II represents the component costs for lamp 200 (FIG. 2) as a percentage of the total direct cost of lamp 100.

TABLE I

| | | |
|---|---|---|
| 1 | sapphire window 104 | 10% |
| 2 | window shell flange 106 | 1.3% |
| 3 | body sleeve 108 | 7.8% |
| 4, 5 | flanges 110, 112 | 1.1% |
| 6, 7, 8 | struts 114 | 1.9% |
| 9 | cathode 116 | 3.7% |
| 10 | elliptical reflector 118 | 30.9% |
| 11 | shell 120 | 1.9% |
| 12 | anode base 122 | 9.2% |
| 13 | base support ring 124 | 4.3% |
| 14 | tungsten anode 126 | 4.5% |
| 15 | tubulation 128 | 1.8% |
| 16 | xenon gas 130 | 7.5% |
| 17 | window coatings 102 | 14.1% |
| | MATERIAL SUBTOTAL | 48% |
| | LABOR SUBTOTAL | 52% |
| | LAMP DIRECT COST | 100% |

The lamp 200 uses six fewer components, compared to lamp 100. Tables I and II show that the labor costs are reduced by fifty-nine percent. Material costs are reduced by sixty-two percent. Overall savings are better than thirty percent.

TABLE II

| | | |
|---|---|---|
| 1 | sapphire window 204 | 10.0% |
| 2 | window shell flange 206 | 2.3% |
| 3 | tubulation 224 | 1.8% |
| 4 | body sleeve 222 | 5.5% |
| 5 | single Kovar strut 218 | 2.8% |
| 6 | cathode 220 | 3.7% |
| 7 | elliptical reflector 228 | 19.4% |
| 8 | anode flange 230 | 3.6% |
| 9 | anode 232 | 4.3% |
| 10 | xenon gas 226 | 7.5% |
| 11 | window coatings | 14.1% |
| | MATERIAL SUBTOTAL | 30% |
| | LABOR SUBTOTAL | 40% |
| | LAMP DIRECT COST | 70% |

A principle reason the labor costs can be so dramatically reduced is the assembly of lamp 200 very much lends itself to automated mass-production techniques. In particular, the differences in the strut assembly.

Figure 3:
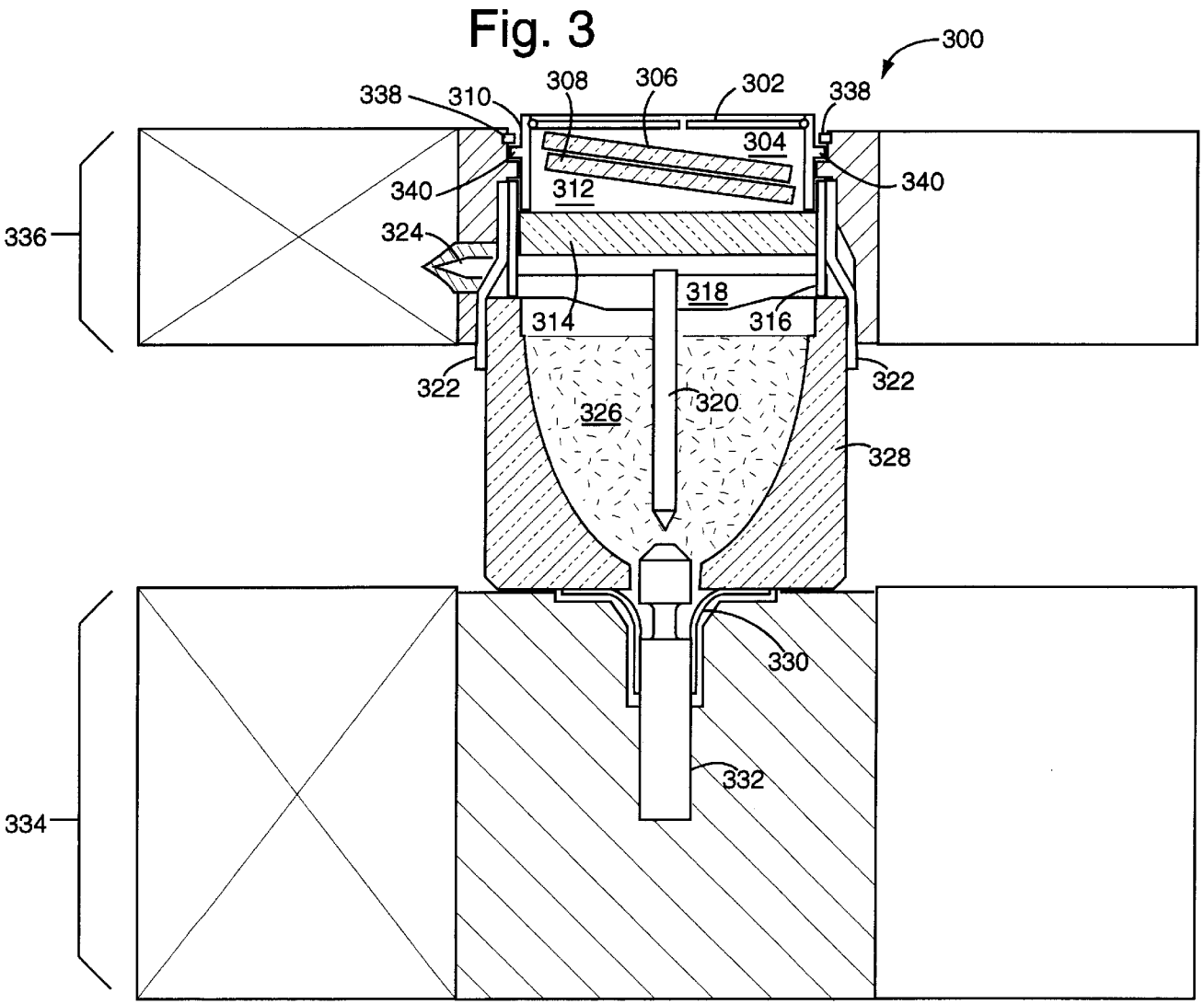
FIG. 3 is a cross section view illustrating a xenon short-arc lamp assembly embodiment of the present invention.

FIG. 3 illustrates a xenon short-arc lamp assembly embodiment of the present invention, and is referred to herein by the general reference numeral 300. The lamp assembly 300 comprises a retaining ring 302, a 10° tilted top collar 304, a blue filter 306, a hot-mirror 308, and a ring housing 310. A 10° tilted bottom collar 312 inside the ring housing 310 matches the orientation of top collar 304. The lamp assembly 300 further includes a sapphire window 314 set in a ring frame 316. A single bar strut 318 attaches at opposite points on the bottom of the ring frame 316 and supports a cathode 320. A body sleeve 322 is fitted with a xenon-fill tubulation 324 that is shown pinched-off and sealed in FIG. 3. A xenon gas atmosphere 326 is contained within a ceramic reflector 328. An anode flange 330 is brazed directly to the flat bottom end of the ceramic reflector 328 and supports a tungsten anode 332.

In operation, a pair of aluminum heatsinks 334 and 336 are attached. The heatsink 336 is contoured to fit the metal body sleeve 322 and must be relieved to clear the xenon gas-fill tubulation 324 after it has been pinched off. The aft heatsink 334 is contoured to snug-fit around the anode flange 330 and tungsten anode 332. Such heatsinks also provide convenient electrical-connection terminal points in that they naturally provide solid connections to the cathode 320 and anode 332, respectively.

The heatsink 336 can be used to help retain the ring housing 310 by including a split-circle spring retainer 338 that traps in a flange lip 340.

Figure 4:
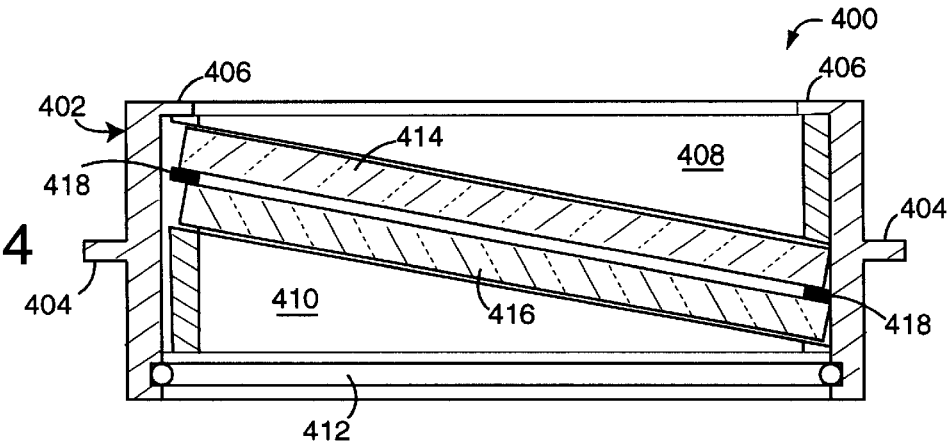
FIG. 4 is a cross section view showing a tilted hot-mirror assembly.

FIG. 4 shows a tilted hot-mirror assembly 400 that comprises an aluminum ring housing 402. An external lip 404 is intended to contact a heatsink and provides for optical alignment of the ring housing 402 with a lamp. An internal lip 406 helps retain a pair of 10° ring wedges 408 and 410 under a snap-ring 412. A blue filter 414 and a hot mirror 416 are held between the 10° ring wedges 408 and 410. A spacing pad 418 separates the blue filter 414 and hot mirror 416. The preferred combinational optical bandpass of the blue filter 414 and hot mirror 416 is 440–525 nanometers wavelength of light.

Figure 5:
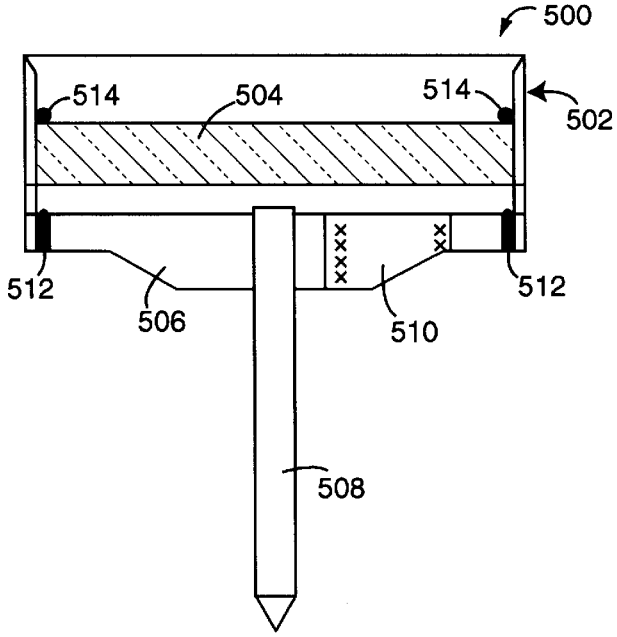
FIG. 5 is a cross section view illustrating a mounted-strut assembly.

FIG. 5 illustrates a mounted-strut assembly 500 that comprises a window flange 502, a sapphire window 504, a molybdenum strut 506, and a tungsten cathode 508. A getter 510 is spot welded to one arm of the strut 506. A braze 512 attaches the strut-cathode sub-assembly to the window flange 502, as does a braze 514 for the window 504. The getter 510 helps trap residual gas contaminants during operation after the lamp is sealed.

Figure 6:
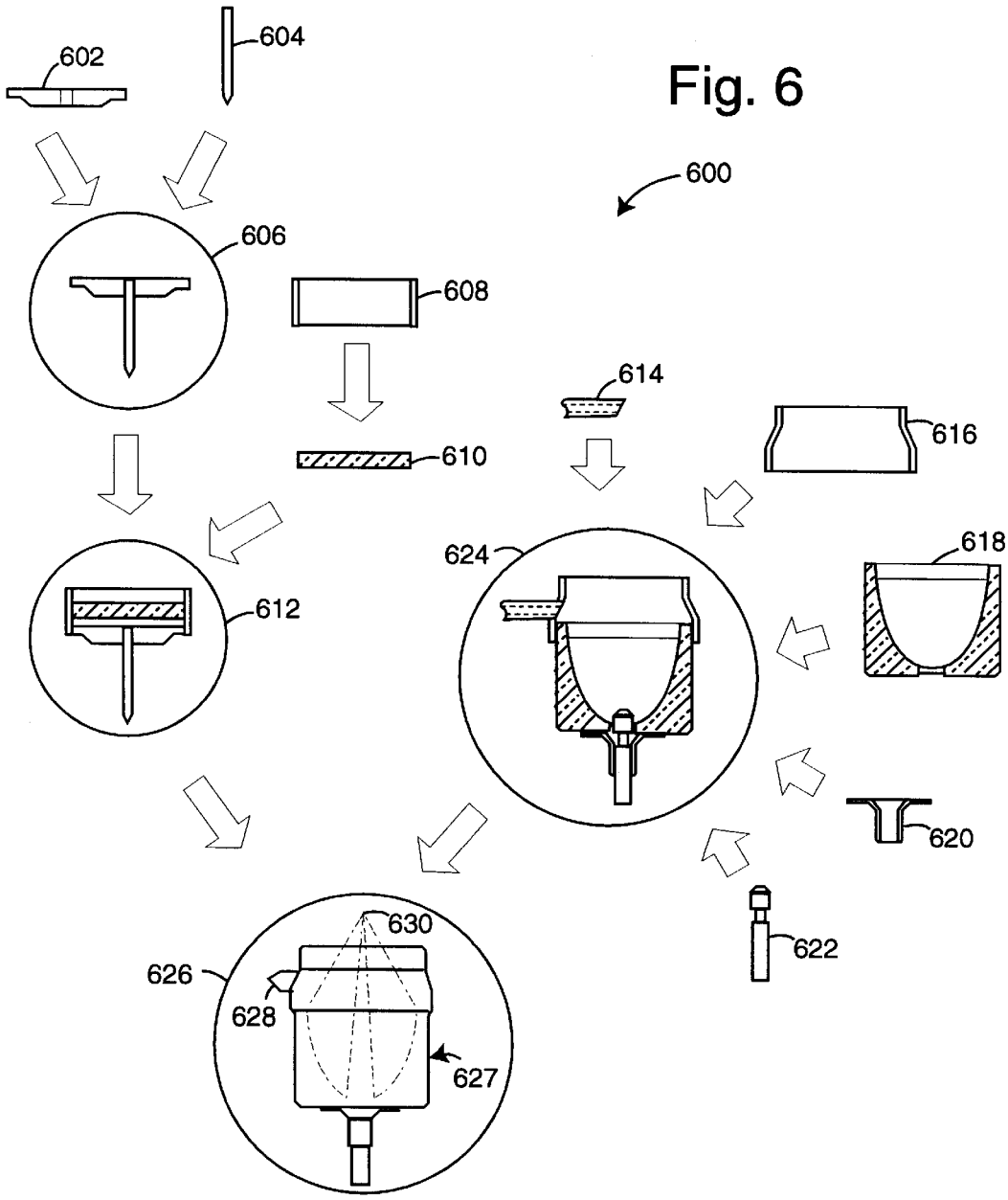
FIG. 6 is a flow chart representing a method of manufacturing for the miniature xenon arc lamp of FIGS. 1–5.

FIG. 6 represents a method of manufacturing for the miniature xenon arc lamp of FIGS. 1–5, and is referred to herein by the general reference numeral 600. A single-bar cathode-support strut 602 made of molybdenum and a tungsten cathode 604 are brazed together as step 606. For example, a palladium-cobalt braze has provided good results. A window flange 608 and a window 610 are brazed together with the product of the strut braze step 606 in a mounted-cathode-braze step 612. For example, a 50/50 silver braze has provided good results. A copper-tube fill tubulation 614, a kovar sleeve 616, a ceramic reflector body 618, an anode flange 620, and a tungsten anode 622 are all brazed together in a "body-braze" step 624. For example, a cusil braze has provided good results. The products of the mounted-cathode-braze step 612 and body-braze step 624 are tungsten-inert-gas (TIG) welded together in a final welding step 626. A lamp 627 is finished by filling it with xenon gas and pinching off the tubulation, e.g., resulting in a pinch-off 628. A focal point 630 is near the lamp-output window.

One such lamp 627 with a reflector diameter of about 0.75" had a operational power level of one-hundred fifty watts. In general, embodiments of the present invention use few parts and require few brazing-welding assembly steps, and FIG. 6 is intended to demonstrate these points clearly by example. By comparison to the prior art, the lamp 627 requires three brazes and one TIG-weld, and uses nine parts. A similar lost-cost lamp manufactured by ILC Technology (Sunnyvale, Calif.) with the same input power, required six such brazes and two TIG-welds. Such prior art lamp uses fifteen parts. So both the reduction in parts count and manufacturing steps dramatically reduces the direct manufacturing costs for similarly powered arc lamps.

Figure 7:
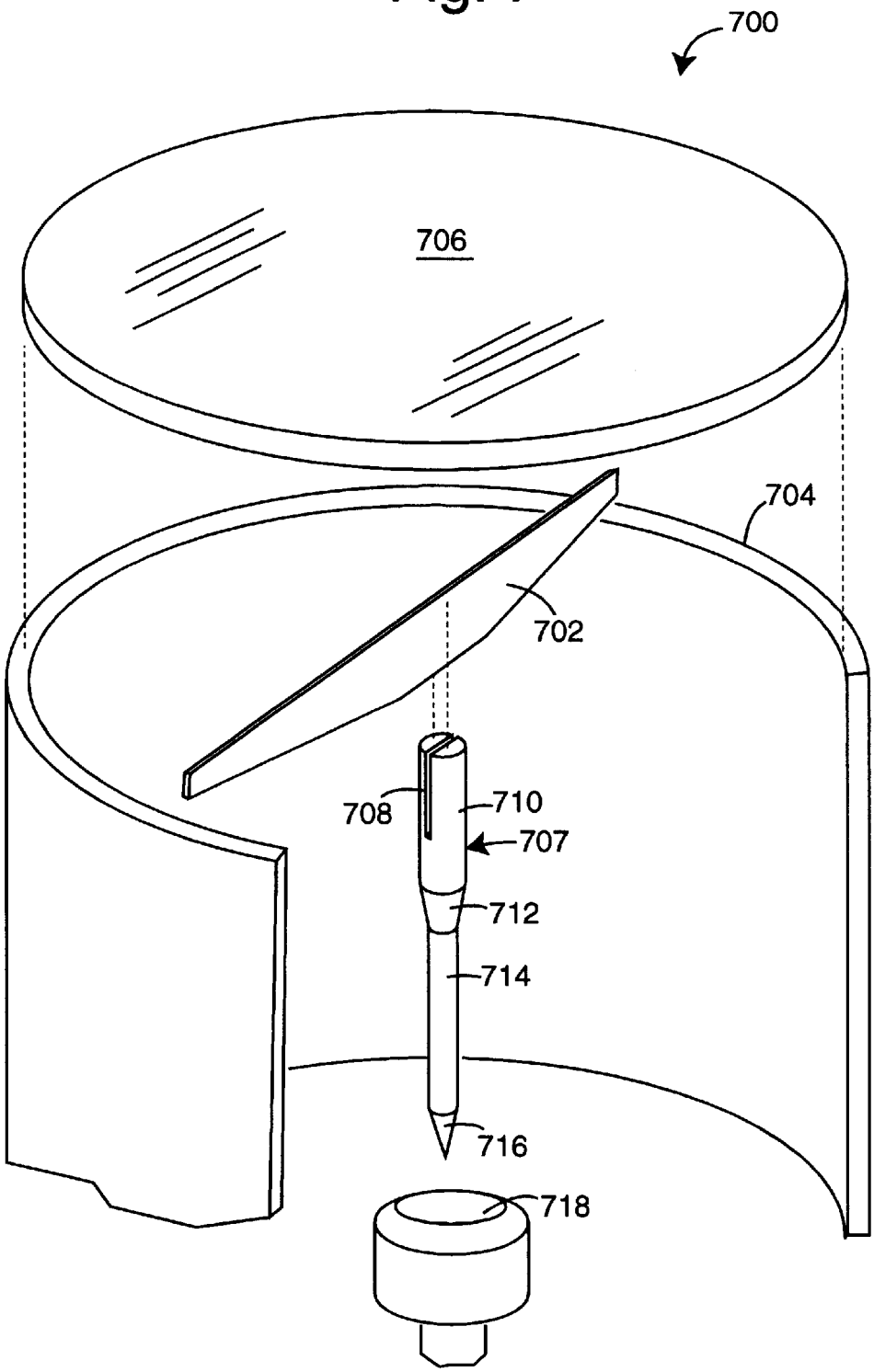
FIG. 7. is an exploded diagram of a cathode strut system embodiment of the present invention.

FIG. 7 represents a cathode strut system embodiment of the present invention, and is referred to herein by the general reference numeral 700. The cathode strut system 700 includes a molybdenum strut 702 that is brazed at opposite ends to the inside of a ceramic lamp body 704. A sapphire window 706 is sealed to the top. A tungsten cathode electrode 707 has a central slot 708 that slips over both sides of the middle of the strut 702 and is brazed in place. A thicker, larger diameter section 710 reduces through a conical transition 712 to a thinner, smaller diameter section 714. A tip 716 is provided in opposition across a gap to an anode electrode 718.

Such use of a slot 708 to mount cathode 707 on the strut 702 results in more uniform and symmetrical heat and thermal stress loading in all the parts-during operation. Even after five hundred hours of use, prototypes of embodiments of the present invention have suffered only a minimal amount of cathode tip wander.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. An improved xenon arc lamp including an anode, a reflector, and a gas-fill tubulation in an anode assembly, the improvement comprising:

a single edge-to-edge cathode support bar;

a medial slot at one end of a cathode electrode and providing for attachment around both sides of the middle of said single edge-to-edge cathode support bar; and a braze that joins the cathode support bar to the inside of the medial slot on both sides of the medial slot, and providing for uniform and symmetrical heat loading in said cathode electrode and single edge-to-edge cathode support bar to limit cathode tip wander during operation.

2. The lamp of claim 1, wherein:

the cathode has a larger diameter section that is slotted, and a conical transition to a smaller diameter section that ends in said arc tip.

3. The lamp of claim 1 further comprises a basic set of nine component parts that are fastened together by three distinct brazes and one TIG-weld, which includes a palladium-cobalt braze that fuses said single-bar cathode-support strut and said slotted end of the cathode into a mounted-cathode subassembly.

4. The lamp of claim 3, wherein:

the basic set of nine component parts is such that a single braze fuses together a window flange and a sapphire output window with said mounted-cathode subassembly.

5. The lamp of claim 3, wherein:

the basic set of nine component parts is such that a single body-braze holds together a copper-tube fill tubulation, a Kovar sleeve, a ceramic reflector body, an anode flange, and a tungsten anode in a body-braze subassembly.

6. The lamp of claim 5, wherein:

the basic set of nine component parts is such that a single tungsten-inert-gas (TIG) weld joins together said mounted-cathode subassembly and said body-braze subassembly.

7. A xenon arc lamp, comprising:

a set of nine component parts limited to (a) an output window, (b) a window flange, (c) a cathode-support strut, (d) a medial slotted-end cathode, (e) a body sleeve, (f) a gas-fill tubulation, (g) a reflector body, (h) an anode flange, and (i) and anode all joined together and each individually providing for complete assembly by three individual brazes and one TIG-weld into a finished xenon arc lamp.

8. The lamp of claim 7, wherein:

said cathode-support strut and said cathode are joined together in a single two-sided braze by a medial slot in one end said cathode.

9. The lamp of claim 8, wherein:

said output window and said window flange are brazed together with said cathode-support strut and said cathode.

10. The lamp of claim 7, wherein:

said body sleeve, said gas-fill tubulation, said reflector body, and said anode flange are fused together by one braze.

11. The lamp of claim 8, wherein:

said body sleeve, said gas-fill tubulation, said reflector body, and said anode flange are fused together by one braze; and said output window, window flange, cathode-support strut and cathode, have a single TIG-weld to said body sleeve, said gas-fill tubulation, said reflector body, and said anode flange.

* * * * *